US008490836B2

(12) United States Patent
Rasmussen

(10) Patent No.: US 8,490,836 B2
(45) Date of Patent: Jul. 23, 2013

(54) METHOD AND ASSEMBLY FOR GUIDING A DISPENSING LINE THROUGH A BEVERAGE DISPENSER

(75) Inventor: Jan N. Rasmussen, Ølstykke (DK)

(73) Assignee: Carlsberg Breweries A/S, Copenhagen V (DK)

( * ) Notice: Subject to any disclaimer, the term of this patent is extended or adjusted under 35 U.S.C. 154(b) by 892 days.

(21) Appl. No.: 12/063,528

(22) PCT Filed: Aug. 10, 2006

(86) PCT No.: PCT/DK2006/000438

§ 371 (c)(1),
(2), (4) Date: Apr. 13, 2010

(87) PCT Pub. No.: WO2007/019851

PCT Pub. Date: Feb. 22, 2007

(65) Prior Publication Data

US 2010/0206906 A1 Aug. 19, 2010

(30) Foreign Application Priority Data

Aug. 12, 2005 (DK) ..... 2005 01144

(51) Int. Cl.
*B67D 7/80* (2010.01)

(52) U.S. Cl.
USPC ..... 222/146.6; 222/1; 222/94; 222/105; 222/129.1; 222/131; 222/183; 222/394

(58) Field of Classification Search
USPC ..... 222/1, 94, 95, 105, 131, 146.6, 182, 222/183, 394, 399, 129.1
See application file for complete search history.

(56) References Cited

U.S. PATENT DOCUMENTS

| | | | | |
|---|---|---|---|---|
| 7,140,514 | B2 * | 11/2006 | Van Der Klaauw et al. | 222/146.6 |
| 8,028,857 | B2 * | 10/2011 | Rasmussen | 222/1 |
| 2002/0050496 | A1 * | 5/2002 | Van Der Meer et al. | 222/105 |
| 2004/0069368 | A1 * | 4/2004 | van der Klaauw et al. | 141/82 |

FOREIGN PATENT DOCUMENTS

| | | |
|---|---|---|
| WO | WO 81/02002 | 7/1981 |
| WO | WO 01/92144 | 12/2001 |

* cited by examiner

*Primary Examiner* — J. Casimer Jacyna
(74) *Attorney, Agent, or Firm* — Klein, O'Neill & Singh, LLP

(57) ABSTRACT

An assembly for dispensing a beverage from a beverage container includes a cooling chamber containing a pressure chamber configured to accommodate the container and having a lid with a lid opening. The assembly further includes a dispensing tower and a dispensing line channel extending between a lower opening in the cooling chamber and an upper end in the tower. The lid opening is alignable with the lower opening of the channel so that the lid opening provides a guiding element for the passage of a dispensing line between the pressure chamber and the tower through the channel. A method of guiding the dispensing line includes opening the lid of the pressure chamber; aligning the lid opening with the lower opening of the channel; and guiding the dispensing line so that it extends through the lid opening and the channel.

20 Claims, 10 Drawing Sheets

Fig. 3A
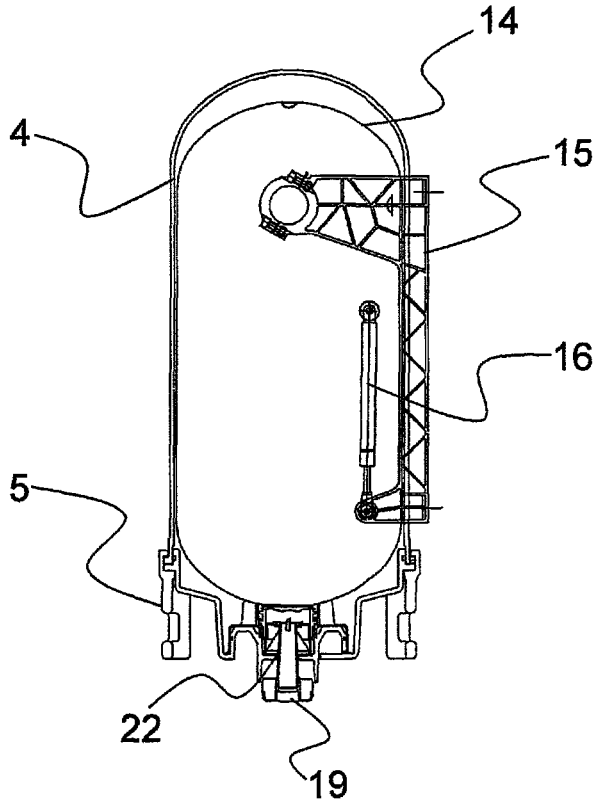
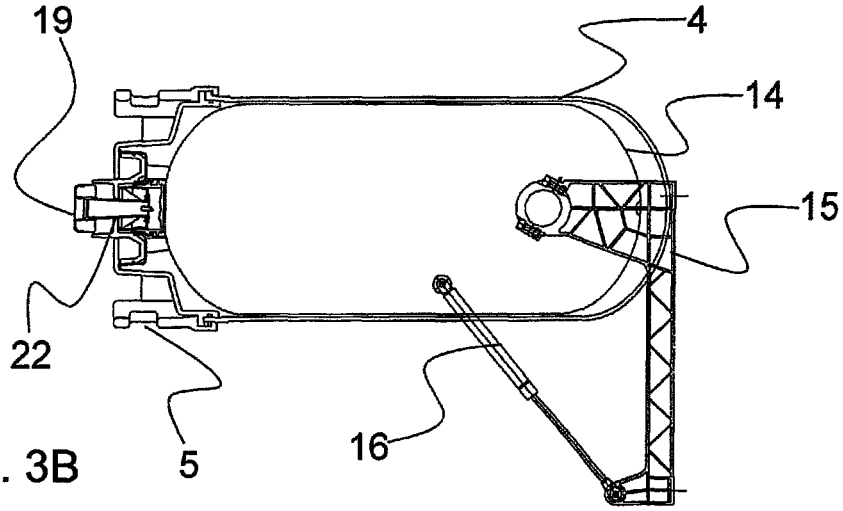
Fig. 3B

METHOD AND ASSEMBLY FOR GUIDING A DISPENSING LINE THROUGH A BEVERAGE DISPENSER

CROSS REFERENCE TO RELATED APPLICATION

This application is the national phase entry, under 35 U.S.C. §371(c), of co-pending International Application No. PCT/DK2006/000438, filed Aug. 10, 2006, the disclosure of which is incorporated herein by reference in its entirety.

FEDERALLY SPONSORED RESEARCH OR DEVELOPMENT

Not Applicable

TECHNICAL FIELD OF THE INVENTION

The invention relates to a method for guiding a dispensing line through a dispensing line channel in an assembly for dispensing beverage. The invention also relates to an assembly adapted for guiding a dispensing line through a dispensing line channel.

BACKGROUND OF THE INVENTION

In the art of beverage dispensing devices, techniques have evolved over the years in methods for connecting equipment, such as pressurized chambers via beverage dispensing lines through dispensing line channels to dispensing taps. The techniques involve lifting and maneuvering of heavy and bulky beverage containers and managing of parts such as lids, dispensing lines and empty containers. Recently a new kind of dispensing assembly has been introduced, some of these assemblies comprising exchangeable dispensing lines which are replaced together with the replacement of beverage container. A dispensing line connects a beverage container with a dispensing tap and is generally led through a protective shielding such as a dispensing line channel.

When replacing a beverage container in a pressure chamber the process includes disconnection and removal of a used dispensing line as well as connection of a new dispensing line. The procedure further involves the introduction and leading of the dispensing line through a dispensing line channel and the connection of the dispensing line with a dispensing tap and the new beverage container.

The methods used today are afflicted with installing difficulties as well as problems with cleanliness and hygiene.

Furthermore, the job is often carried out in environments where stress and hastiness contribute to making errors, sometimes costly, sometimes influencing the quality of the beverage when served to customers.

More specifically, the process of introducing a dispensing line into a dispensing line channel and connecting the dispensing line to a dispensing tap and a beverage container is associated with a number of drawbacks. For instance, the dispensing line is difficult to introduce in the openings of a dispensing line channel. The process of finding the entrance for the dispensing line to be guided through is further complicated by the frequently poor lighting conditions in the environments of bars and the like. Furthermore, due to the number of items to maneuver with the dispensing line easily becomes squeezed or clamped between the lid and the walls of the pressure chamber. Furthermore, after the lid has been separated from the pressure chamber it is put away and easily forgotten when assembling the system. Furthermore, the separation of the lid may cause it to end up on the floor or elsewhere where it is exposed to contamination. Furthermore, the number of loose items to manage in the process increases the risk also for the dispensing line or other parts ending up in contaminated areas. Hence, there is a need for the provision of a solution to the above stated shortcomings of the techniques used today.

It is an object of the present invention to overcome drawbacks of prior art solutions, and to provide a flexible dispensing assembly which is easy to use.

SUMMARY OF THE INVENTION

According to the present invention there is provided a method for guiding a dispensing line through a dispensing line channel in an assembly for dispensing beverage. The dispensing line channel has a first end in a tower and a second end arranged in connection with a cooling chamber. The cooling chamber comprises a pressure chamber having a lid with an opening for the dispensing line. The pressure chamber is further adapted during operation to accommodate a beverage container. The method comprises the steps of:

- opening the lid of the pressure chamber,
- aligning the opening of the lid with the opening of the second end of the dispensing line channel, and
- guiding a dispensing line through the opening of the lid and the second end of the dispensing line channel, further through said channel and out of said first end of said channel or the reverse direction.

By this procedure the dispensing line only needs guiding through one opening, namely that of the lid.

According to one embodiment of the invention, the method may further comprise one or more of the following steps:

- loading a beverage container into the pressure chamber,
- leading the lid from the pressure chamber along a dispensing line set up for operation in the assembly to the opening of the second end of the dispensing line channel,
- attaching the lid to the second end of the dispensing line channel by having connection between complementary connecting means on said lid and said second end of the dispensing line channel,
- leading the lid from the alignment with the second end of the dispensing line channel along the dispensing line to the pressure chamber, closing the pressure chamber, and/or
- removal of a dispensing line from the dispensing line channel and/or the beverage container from the pressure chamber.

Attaching the lid to the end of the dispensing line channel ending in the cooling chamber provides a natural, intermediate storage and there is no risk of forgetting to guide the dispensing line through the opening of the lid. The process of guiding the dispensing line is thus made comfortable and hassle-free with ergonomic operating positions, especially due to an elevation of the dispensing line channel above the floor. Furthermore, the risk of contamination is considerably reduced by this enhanced process. There are fewer loose parts to manage and maneuver with and the convenient multipurpose position for the lid is at a safe distance away from contaminated environments such as a bar counter or a floor.

In a further embodiment of the invention, the lid is detachable from or pivotally attached to the pressure chamber.

Preferably, the connecting means are arranged for coaxial alignment of the opening of the lid with the second end of the dispensing line channel. A well-defined coaxial alignment together with correspondingly shaped and aligned cross sections of the openings in the lid and the dispensing line channel provide a connection with a smooth junction for the dispensing line to pass.

According to a second aspect of the present invention there is provided an assembly for dispensing beverage comprising a pressure chamber having a lid, said lid comprising an opening for a dispensing line;

a dispensing line channel having a first end in a tower and a second end arranged in connection with a cooling chamber, and said pressure chamber further being adapted during operation to accommodate a beverage container, wherein the assembly comprises means for aligning the opening of the lid with the opening of the second end of the dispensing line channel so that the opening of the lid can be used as a guiding element for the dispensing line.

Preferably, according to the second aspect of the invention the opening of the lid of the pressure chamber is essentially centred centered.

The assembly according to the second aspect of the invention may comprise a lid, which is detachable from or pivotally attached to the pressure chamber. By having the lid connected to the pressure chamber in its open state, such as by hinge means, the number of individual elements to handle is restricted and as a result, the process of replacing a beverage container is thus improved.

The lid and the second end of the dispensing line channel in the assembly according to the second aspect of the invention may further comprise connection means that are complementary to each other and adapted to attaching the lid to the second end of the dispensing line channel.

Preferably, according to the second aspect of the invention the connection means are arranged for coaxial alignment of the opening of the lid with the second end of the dispensing line channel.

The connection means of the lid and the second end of the dispensing line channel according to the second aspect of the invention may further comprise a threaded socket, snap connection, a catch, a bayonet coupling, a hook, a jig or any combination thereof.

According to the invention, the lid may further comprise guiding means for guiding a beverage container into position in said pressure chamber during operation. Preferably, an opening is arranged in the guiding means, and the connection means are floating suspended in the guiding means opening. The term "floating suspended" is in this context to be construed as having the connection means movable in a lateral and axial direction, preferably so as to enable various angular directions of the connection means in relation to the lid, the axial direction being along the longitudinal elongation of the pressure chamber and the lateral direction being in a direction perpendicular to the axial direction. The degree of manoeuvring freedom of the connection means may further be restricted to pre-determined distances.

The guiding means provides an expedient way to secure that any misalignment, which may exist between the opening of the lid when the lid is placed and locked on the pressure chamber and the dispensing line is overcome. Thus, it is also avoided that the dispensing line will be squeezed or get caught between the lid and the beverage container.

The lid in the assembly according to the second aspect of the invention may be made of a material such as metal, plastic, carbon fibre or the like.

Additionally, the lid according to the second aspect of the invention may further comprise a handle.

Furthermore, the lid according to the second aspect of the invention may comprise elements arranged to guide the dispensing line upon entry into the opening of the lid, such as a funnel-like portion.

BRIEF DESCRIPTION OF THE DRAWINGS

The invention and its many advantages will be described in more detail below with reference to the accompanying schematic drawings, which for the purpose of illustration show some non-limiting embodiments and in which FIG. 1 schematically depicts an assembly according to the invention in a front view;

FIG. 3A depicts the pressure chamber in a first, operating position, and FIG. 3B depicts the pressure chamber in a second, loading position;

All the figures are highly schematic and not necessarily to scale, and they show only parts which are necessary in order to elucidate the invention, other parts being omitted or merely suggested.

DETAILED DESCRIPTION OF PREFERRED EMBODIMENTS

Throughout this description, the preferred embodiments and examples shown should be considered as examples, rather than as limitations on the present invention.

Figure 1:
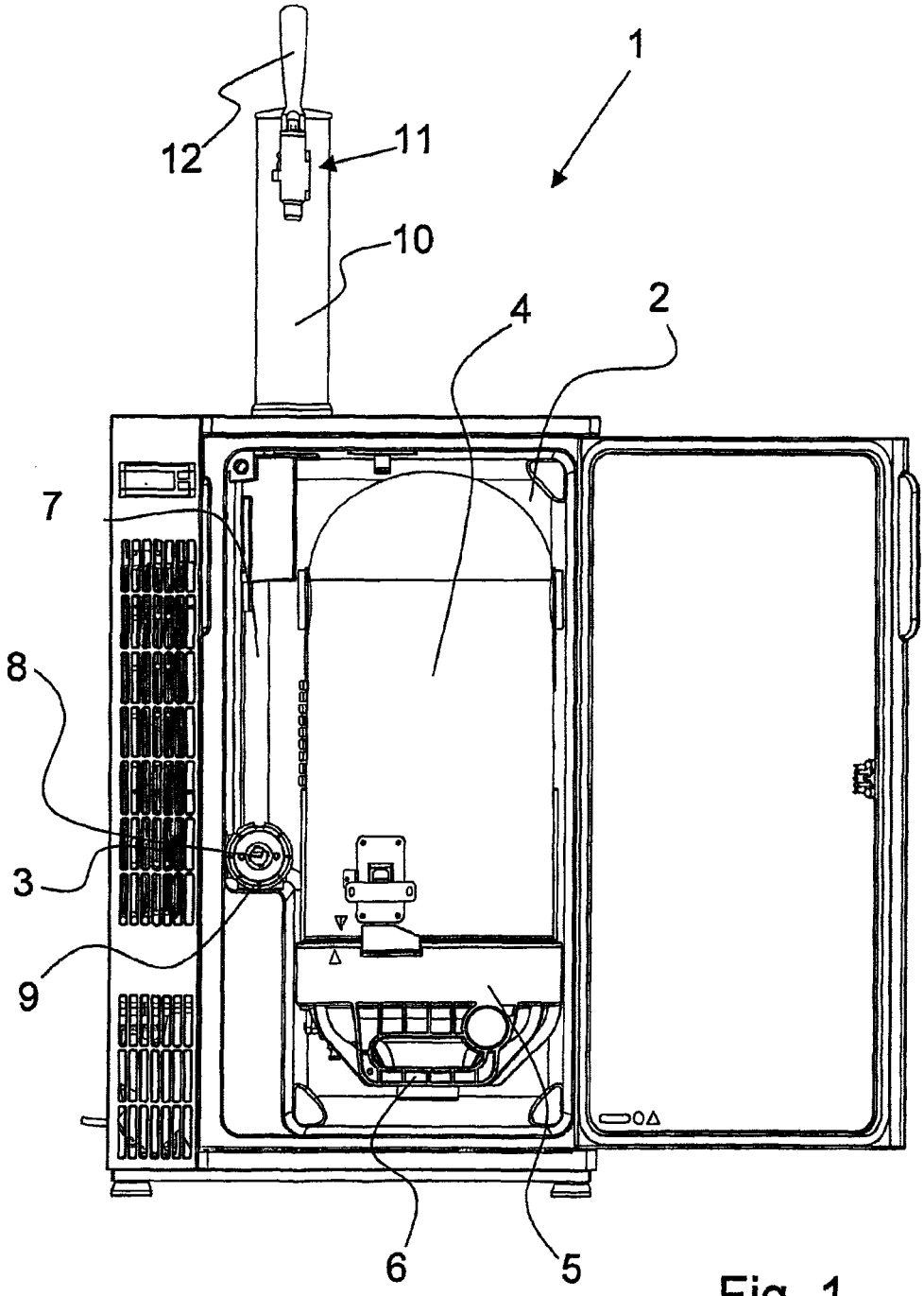
Figure 2:
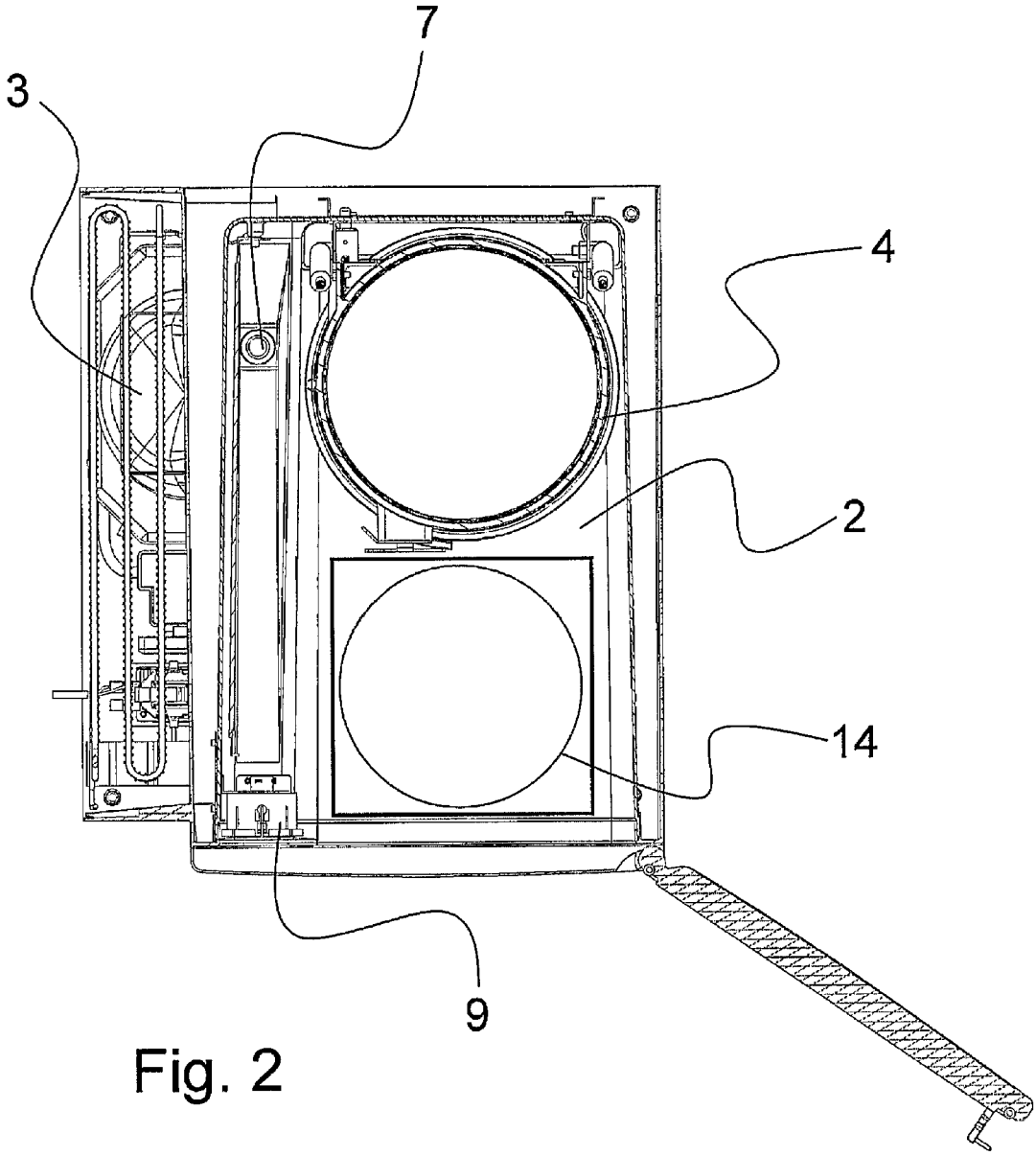
FIG. 2 depicts the assembly of FIG. 1 in a sectional top view.
Figure 4:
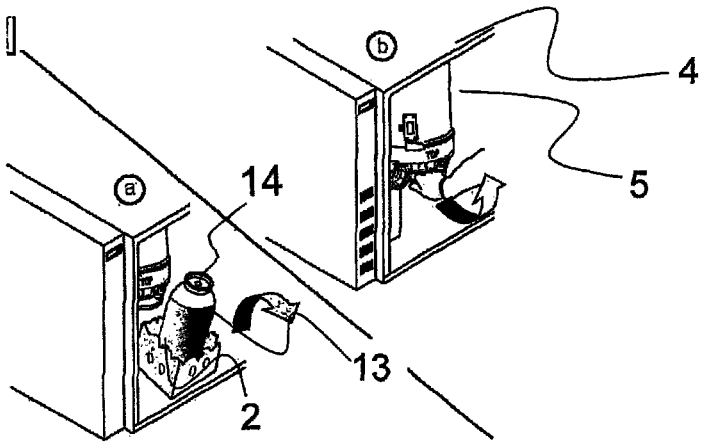
FIG. 4 depicts a front view of the cooling chamber, showing the steps of replacing a beverage container.

FIG. 1 shows a front view of a dispensing assembly 1 comprising a cooling chamber 2, a cooling system 3, a pressure chamber 4, a pressure chamber lid 5 having a handle 6, a dispensing line channel 7 with a lower opening 8 arranged with connection means 9 for connection with the lid 5, and a tower 10 that includes a dispensing tap 11 with a tap actuator 12. The pressure container is adapted to hold a beverage container 14 (FIG. 2). The placement of the tower 10 may be flexible in relation to the rest of the dispensing assembly 1, and may very well differ from what is shown in FIG. 1. For instance, the tower 10 may be placed on top of a bar desk (not shown), with the rest of the dispensing assembly 1 being below the bar desk or even in another room.

FIG. 2 shows a cross sectional top view of the dispensing assembly 1 shown in FIG. 1 with the pressure chamber 4 and a beverage container 14 in the cooling chamber 2. FIG. 2 further shows the cooling system 3 and the connection means 9 of the dispensing line channel 7. Other configurations can be implemented and it is not a requirement for the system to have a container 14 on precooling in the cooling compartment, neither is it a requirement to have a section for pre-cooling at all. Furthermore, no restriction is made to the number of precooling containers 14 the system may comprise at any given time.

FIGS. 3A and 3B show a side view of the pressure chamber 4 with lid 5, a beverage container 14, and hinge means 15. In a preferred embodiment of the invention, the hinge means 15 comprise a spring lifting mechanism with springs 16.

Figure 9:
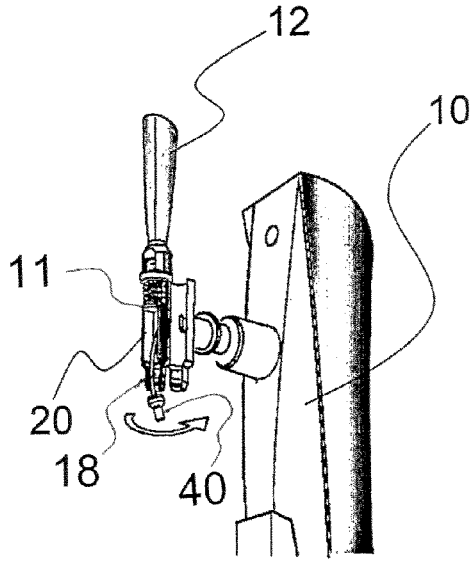
FIG. 9 depicts the release of the dispensing line at the tower.
Figure 10:
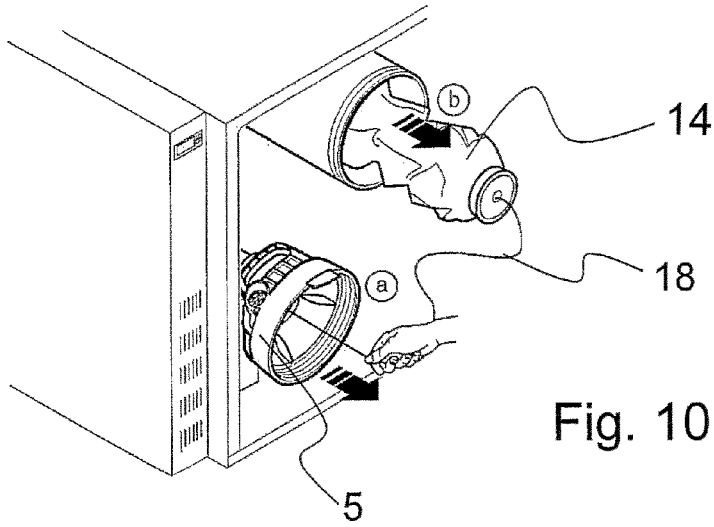
FIG. 10 depicts the retracting of a dispensing line a) and the removal of an empty beverage container b)
Figure 11:
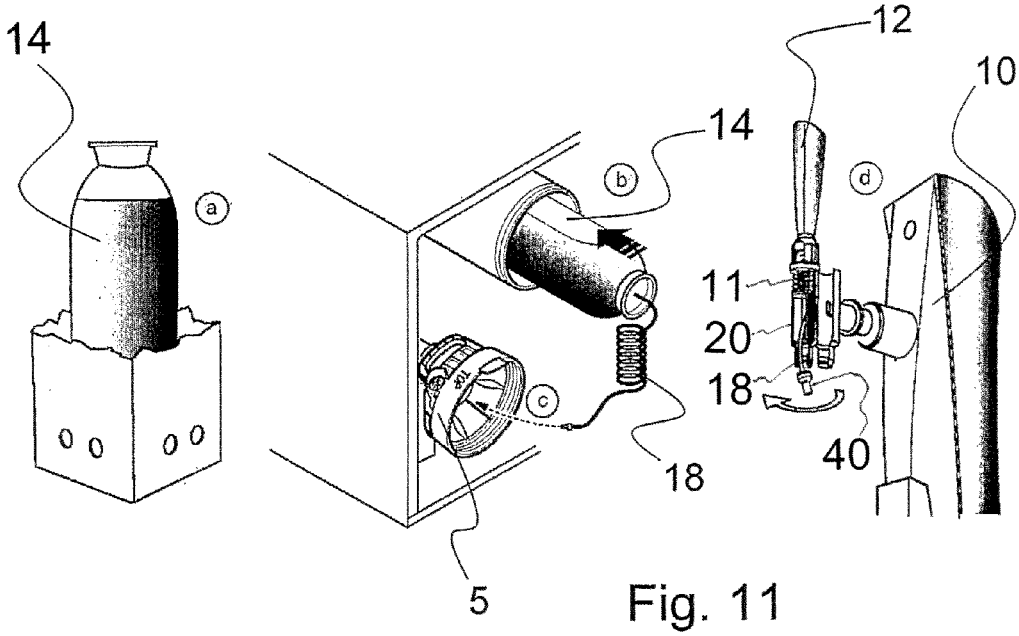
FIG. 11 depicts the loading of a beverage container and the connection of a dispensing line, according to one embodiment of the invention.
Figure 12:
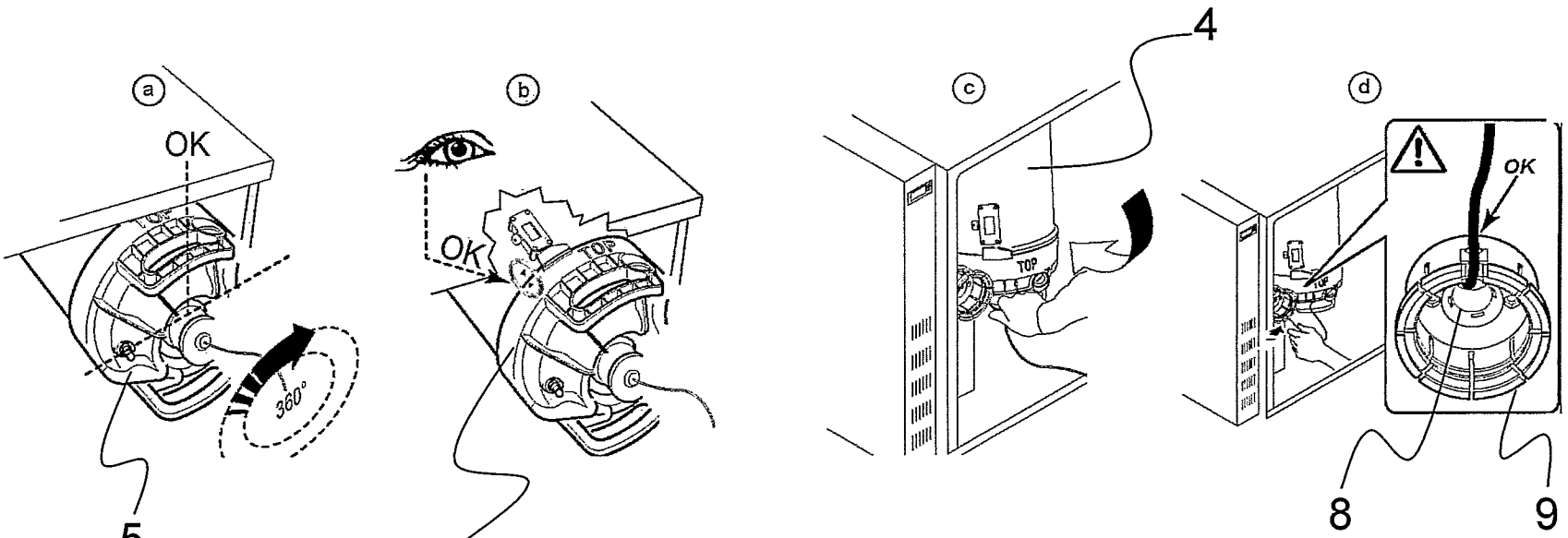
FIG. 12 illustrates a preferred way of securing the lid on the pressure chamber and the remaining steps of loading of the pressure chamber.

FIGS. 4 to 12 show an embodiment of the invention wherein replacement of an empty beverage container 14 is carried out. More specifically, FIGS. 4 to 10 show the sequence of steps carried out to remove a used beverage container 14 from the dispensing assembly 1, and FIGS. 11 and 12 show the loading and installing of a new beverage container 14.

FIG. 4*a* shows the removal of a beverage container 14 from a pre-cooling position to allow access to the pressure chamber 4. FIG. 4*b* indicates the bringing of the pressure chamber 4 from a vertical operating position to a horizontal loading position by gripping the handle 6 and lifting outwards and upwards defining a slowly rotating motion. The hinge means 15 in FIG. 3 ensures steady and easy lifting. The configuration ensures comfortable and easy access to the pressure chamber 4 when replacing a beverage container 14.

Figure 5:
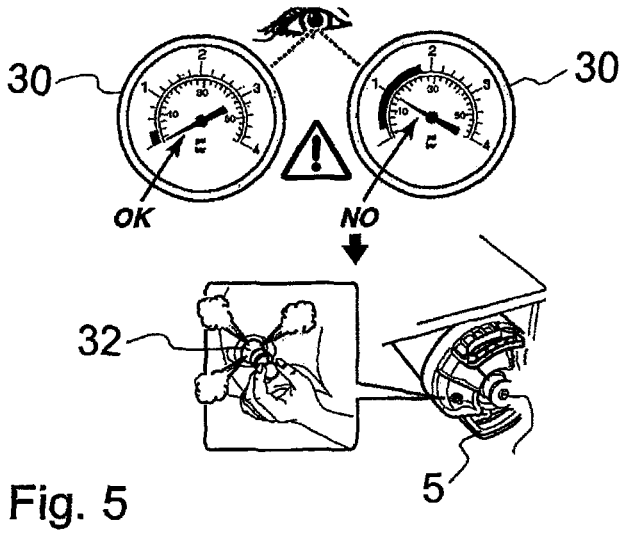
FIG. 5 depicts a pressure meter and pressure release valve in connection with the pressure chamber.

FIG. 5 shows a pressure gauge 30 indicating states of pressure and no pressure present in the pressure system. FIG. 5 further shows the release of air through a pressure relief valve 32 on the lid 5 of the pressure chamber 4. The pressure system is controlled automatically, however, for safety and monitoring reasons, it is provided a pressure gauge 30 as shown in FIG. 5 in connection with the pressure container. If there is still a pressure in the system, manual release can be carried out by opening of the pressure relief valve 32, as illustrated in FIG. 5.

Figure 6:
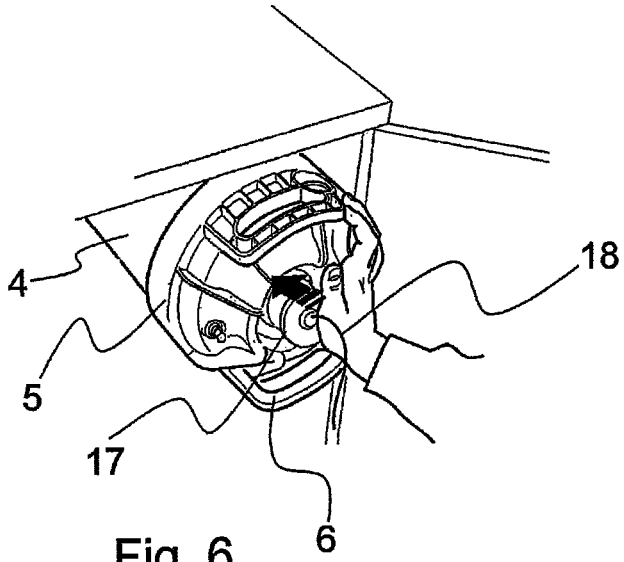
FIG. 6 depicts the lid of the pressure chamber.

FIG. 6 shows the lid 5 of the pressure chamber 4 and illustrates the application of a slight pressure to the lid 5 to release the beverage container 14 (not shown) inside the pressure container from the lid 5.

Figure 7:
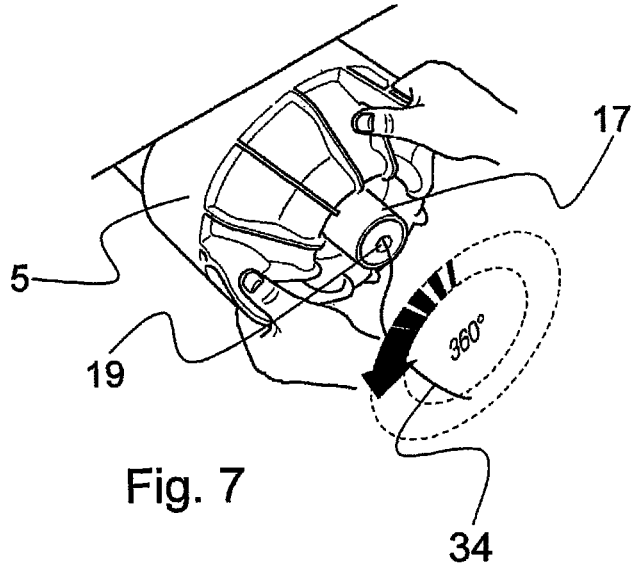
FIG. 7 depicts the removal of the lid from the pressure chamber.

FIG. 7 shows the lid 5 of the pressure chamber 4 and illustrates the unlocking and releasing of the lid 5 from the pressure chamber 4. In a preferred embodiment of the invention, the lid 5 is rotated counter clockwise 360 degrees, as indicated by the arrow 34.

Figure 8:
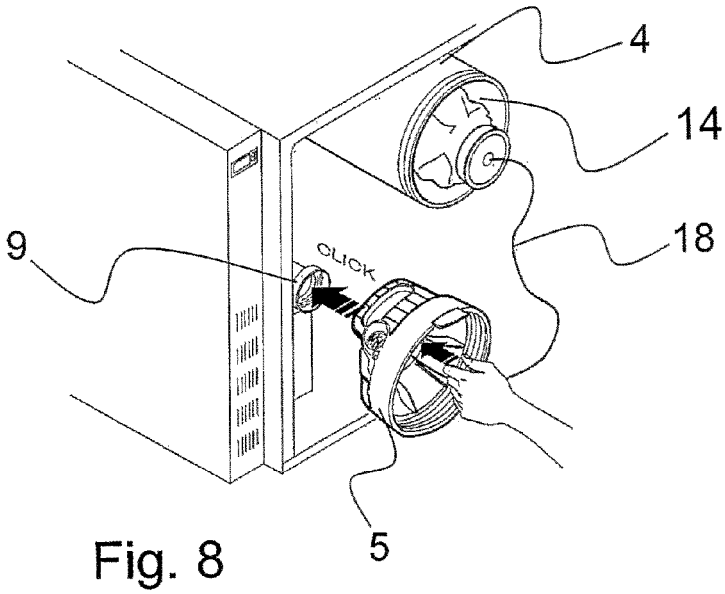
FIG. 8 depicts the connection of the lid with the dispensing line channel.

FIG. 8 shows the cooling chamber 2, pressure chamber 4 with a used beverage container 14 inside, the dispensing line channel 7, the lid 5 and a dispensing line 18. The lid 5 has been detached from the pressure container and is led along the dispensing line 18 to the opening 8 of the dispensing line channel 7 where the opening 19 of the lid 5 is aligned to the opening 8 of the dispensing line channel 7. A slight pressure applied to the lid 5 activates a snap connection attaching the lid 5 to the dispensing line channel 7.

FIG. 9 shows a view of the tower 10 as shown in FIG. 1 with a dispensing tap 11 with a tap actuator 12 and a dispensing line 18, where the dispensing line 18 is released from the dispensing tap 11 on the tower 10. The dispensing line channel 7 has an upper end 20 in the tap 11.

In FIG. 10, it is shown at "a" how the dispensing line 18 is retracted from the dispensing line channel 7 by gently pulling it out through the opening 19 of the lid 5. Fig. at "b" then illustrates how the used beverage container 14 easily is removed from the pressure container.

FIG. 11 at "a" shows the release of a container 14, preferably a pre-cooled one, from its transport packaging. The container 14 is then inserted into the pressure chamber 4 as shown in FIG. 11 at "b". In FIG. 11 at the dispensing line 18 according to the invention is guided through the lid 5 and further through the dispensing line channel 7. The dispensing line 18 emerges from the dispensing tap 11 and is locked into a dispensing position as shown in FIG. 11 at "d".

Correspondingly to FIG. 8 the lid 5 is led from the alignment with the end of the dispensing line channel 7 along the dispensing line 18 to the pressure chamber 4, closing the pressure chamber 4.

FIG. 12 at "a" illustrates the locking of the lid 5 to the pressure chamber 4 which, according to a preferred embodiment is carried out by turning the lid 5 clock wise 360 degrees. After proper locking of the lid 5 is confirmed, as shown in FIG. 12 at "b", the pressure container is brought into position for operation, as shown in FIG. 12 at "c". To prevent clamping or squeezing, the dispensing line 18 is attached, preferably to the connection means 9 of the dispensing line channel 7 as shown in FIG. 12 at "d". A new container 14 is inserted in the cooling chamber 2 for pre-cooling. Finally, the door to the cooling chamber 2 is closed and the dispensing assembly 1 will be ready for use in a few minutes after the correct operating pressure has been obtained.

Figure 13:
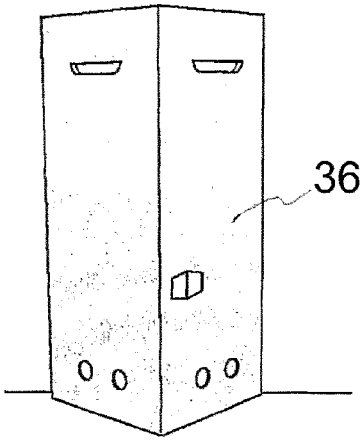
FIG. 13 illustrates a box containing a beverage container.
Figure 14:
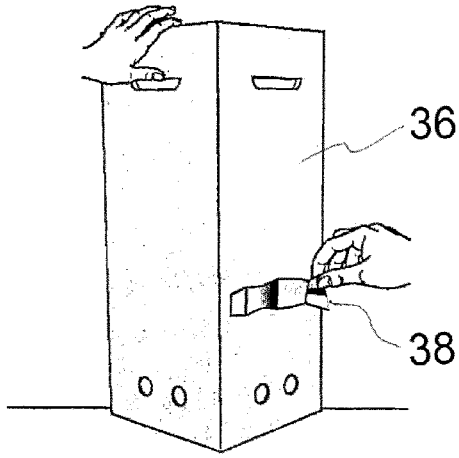
FIG. 14 depicts the opening of the box with a tear string.
Figure 15:
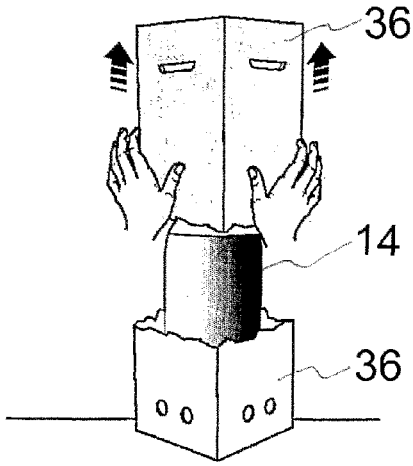
FIG. 15 depicts the removal of a top section of the box.
Figure 16:
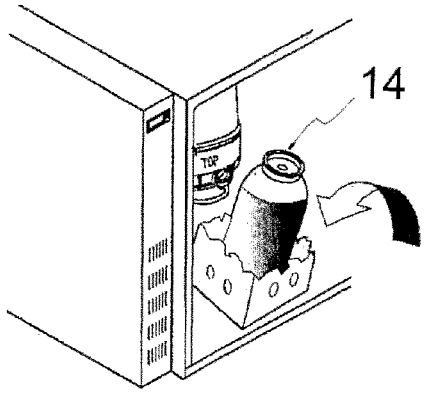
FIG. 16 depicts the inserting of the bottom part of the box with the beverage container into the cooling chamber.

FIGS. 13-16 show a sequence of unwrapping and introducing a new beverage container 14 in the pre-cooling section of the cooling chamber 2. FIG. 13 shows a protective box 36 containing a beverage container 14. The box 36 may be made of a material such as cardboard, and it may further comprise handles as illustrated in FIG. 13. FIG. 14 shows how the box 36 is conveniently opened by pulling a tearing string 38 encircling the box. Thereby, the top part of the box 36 is detached from the bottom part, lifted and removed, as depicted in FIG. 15. Hence, the top part of the beverage container 14 is revealed, thereby reducing isolating effects as well as making a subsequent loading of the beverage container 14 quicker and easier. FIG. 16 illustrates how the beverage container 14 is introduced in the pre-cooling section of the cooling chamber 2.

Figure 17:
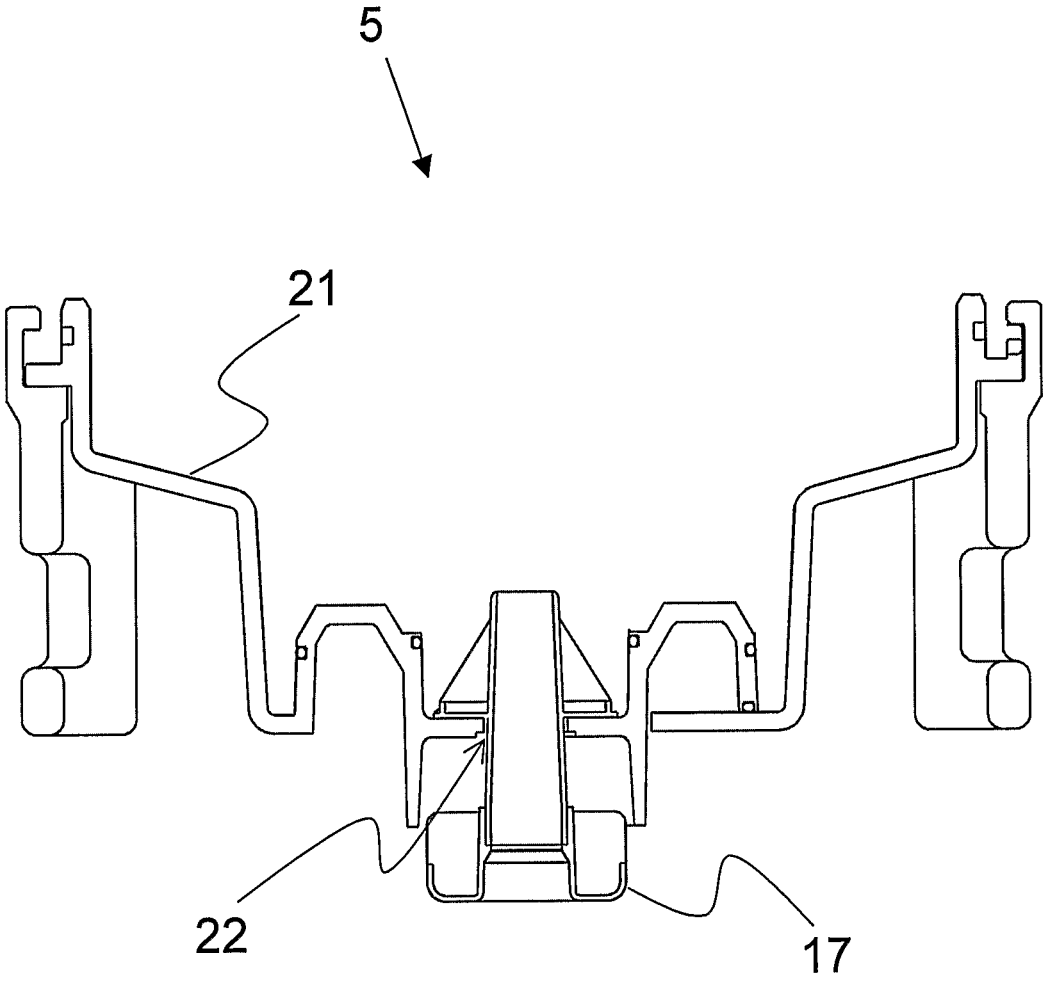
FIG. 17 depicts a cross section of the lid of the pressure chamber.

FIG. 17 shows a cross sectional view of the lid 5 of the pressure chamber 4 depicting guiding means 21 for guiding a beverage container 14 (not shown) into position in the pressure chamber 4 during operation. An opening 22 is arranged in the guiding means 21 for allowing floating suspension of the connecting means 17 for attaching the lid 5 to the second end of a dispensing line channel 7 (not shown) as well as for facilitating release of the beverage container from the lid after operation.

According to an alternative embodiment of the invention the dispensing line 18 is separated from the system and thereby has both of its ends free, allowing for free selection of the order in which the dispensing line 18 is connected to the dispensing tap 11 and beverage container 14 and guided through the lid 5 and the dispensing line channel 7. For instance, it could be that the dispensing line 18 is guided from the dispensing tap 11, through the dispensing line channel 7, through the opening 19 of the lid 5 and to the beverage container 14 placed in the pressure chamber 4.

In a further embodiment of the invention, the dispensing line 18 remains connected to the dispensing tap 11 and the dispensing line 18 is detached from the beverage container 14 only.

According to one embodiment of the invention, the lid 5 and the pressure chamber 4 are connected with hinge means 15. The hinge means 15 are thus so arranged as to provide automatic alignment of the opening 19 of the lid 5 with the opening 8 of the dispensing line channel 7 ending in the cooling chamber 2 when the lid 5 is in its open position during replacing of a beverage container 14.

The connecting element 17 of the lid 5 and the connecting element 9 at the lower end of the dispensing line channel 7 ending in the cooling chamber 2 may comprise connection means such as a bushing mechanism, a bayonet coupling, a hook, a jig, an O-ring, a hitch, hook or clutch or any combination thereof. Even though the drawings disclose a valve 40 connected to the outlet end of the dispensing line 18, said valve 40 being replaced with the dispensing line 18, it is within the inventive idea that the valve also may be a separate valve which is not replaced at the same as the dispensing line 18. Thus, the outlet end of the dispensing line 18 and the valve may comprise complementary connection means, which easily may be separated.

Furthermore, the outlet end of the dispensing line 18 (as well as the inlet end if not mounted in the beverage container 14) may comprise a cap, hood or cover which easily may be removed after the guiding through the assembly 1 and just before the dispensing line 18 is mounted in the valve and beverage container 14, respectively. Hereby, it is obtained that the interior of the dispensing line 18 is kept clean, and contamination of this part, which comes in contact with the beverage, is thereby avoided.

The valve (if placed at the dispensing line 18 before the guiding through the assembly 1) may also comprise a cap, hood or cover for the same reasons as mentioned above.

Although the invention above has been described in connection with preferred embodiments of the invention, it will be evident for a person skilled in the art that several modifications are conceivable without departing from the invention as defined by the following claims.

The invention claimed is:

1. A method for guiding a dispensing line (18) through a dispensing line channel (7) in an assembly (1) for dispensing a beverage, the dispensing line channel (7) having an upper end (20) in a dispensing tower (10) and a lower opening (8) in a cooling chamber (2), the cooling chamber (2) comprising a pressure chamber (4) having a lid (5) with a lid opening (19) configured to receive the dispensing line (18), the pressure chamber (4) being configured to accommodate a beverage container (14), said method comprising the steps of:

opening the lid (5) of the pressure chamber (4);

aligning the lid opening (19) with the lower opening (8) of the dispensing line channel (7);

guiding the dispensing line (18) so that it extends through the lid opening (19) and through the dispensing line channel (7); and attaching the lid (5) to the dispensing line channel (7) at the lower opening (8) thereof, by providing a connection between first connecting means (9) at the lower opening (8) of the dispensing line channel (7) and second connecting means (17) on the lid (5).

2. The method of claim 1, wherein the guiding step comprises the step of guiding the dispensing line (18) into the lid opening, through the lower opening (8) of the dispensing line channel (7), through the dispensing line channel (7), and out of the upper end (20) of the dispensing line channel (7).

3. The method of claim 1, wherein the guiding step comprises the step of guiding the dispensing line (18) into the upper end (20) of the dispensing line channel (7), through the dispensing line channel (7), through the lower opening (8) of the dispensing line channel (7), and out of the lid opening (19).

4. The method of claim 1, further comprising the step of loading a beverage container (14) into the pressure chamber (4).

5. The method of claim 1, further comprising the step of leading the lid (5) from the pressure chamber (4) along the dispensing line (18) set up for operation in the assembly (1) to the lower opening (8) of the dispensing line channel (7).

6. The method of claim 1, further comprising the steps of:

leading the lid (5) from the alignment with the lower opening (8) of the dispensing line channel (7) along the dispensing line (18) to the pressure chamber (4); and closing the pressure chamber (4).

7. The method of claim 1, further comprising the step of removing the dispensing line (18) from the dispensing line channel (7).

8. The method of claim 1, further comprising the step of removing the beverage container (14) from the pressure chamber (4).

9. The method of claim 1, wherein the lid (5) is detachable from the pressure chamber (4).

10. The method of claim 1, wherein the lid (5) is pivotally attached to the pressure chamber (4).

11. The method of claim 1, wherein the first and second connecting means (9, 17) are arranged for coaxial alignment of the lid opening (19) with the lower opening (8) of the dispensing line channel (7).

12. An assembly (1) for dispensing a beverage from a beverage container (14), the assembly (1) comprising:

a cooling chamber (2) including a pressure chamber (4), the pressure chamber being configured to accommodate a beverage container (14) and having a lid (5) with a lid opening (19);

a dispensing tower (10); and a dispensing line channel (7) extending between a lower opening (8) in the cooling chamber (2) and an upper end (20) in the dispensing tower;

wherein the lid opening (19) is alignable with the lower opening (8) of the dispensing line channel (7) so that the lid opening (19) provides a guiding element for the passage of a dispensing line (18) between the pressure chamber (2) and the dispensing tower (10) through the dispensing line channel (7);

wherein a first connecting means (9) is provided at the lower opening (8) of the dispensing line channel (7); and wherein the lid (5) includes a second connecting means (17) complementary with the first connecting means (9), the first and second connecting means (9, 17) being operable for attaching the lid (5) to the dispensing line channel (7) at the lower opening (8) thereof.

13. The assembly (1) of claim 12, wherein the lid opening (19) is substantially in the center of the lid (5).

14. The assembly (1) of claim 12, wherein the lid (5) is detachable from the pressure chamber (4).

15. The assembly (1) of claim 12, wherein the lid (5) is pivotally connected to the pressure chamber (4).

16. The assembly (1) of claim 12, wherein the first and second connecting means (9, 17) are arranged for coaxial alignment of the lid opening (19) with the lower opening (8) of the dispensing line channel (7).

17. The assembly (1) of claim 12, wherein the first and second connecting means (9, 17) comprise a connection mechanism selected from the group consisting of at least one of a threaded socket, a snap connection, a catch, a bayonet coupling, a hook, and a jig.

18. The assembly (1) of claim 12, wherein the lid (5) further comprises a guiding surface (21) configured for guiding a beverage container (14) into position in the pressure chamber (4).

19. The assembly (1) of claim 18, wherein the lid (5) includes connecting means (17) that is cooperatively engageable with complementary connecting means (9) at the lower opening (8) of the dispensing line channel (7), and wherein the guiding surface (21) includes a guiding surface opening (22) that allows a floating suspension of the connecting means (17) in the lid (5).

20. The assembly of claim 12, wherein the lid (5) includes a handle (6).

* * * * *

UNITED STATES PATENT AND TRADEMARK OFFICE

CERTIFICATE OF CORRECTION

PATENT NO. : 8,490,836 B2
APPLICATION NO. : 12/063528
DATED : July 23, 2013
INVENTOR(S) : Jan N. Rasmussen It is certified that error appears in the above-identified patent and that said Letters Patent is hereby corrected as shown below:

In the Specification

In column 3, line 20, delete “centred centered.” and insert -- centered --, therefor.

In column 6, line 9, delete “at” second occurrence and insert -- at “c” --, therefor.

In column 7, line 21, delete “same” and insert -- same time --, therefor.

Signed and Sealed this
Twenty-sixth Day of November, 2013

Margaret A. Focarino

Margaret A. Focarino
*Commissioner for Patents of the United States Patent and Trademark Office*